US006385881B1

(12) United States Patent
Hess

(10) Patent No.: US 6,385,881 B1
(45) Date of Patent: May 14, 2002

(54) SYNCHRONIZED FLICKER DEVICE

(75) Inventor: Kristoffer Hess, Cambridge (CA)

(73) Assignee: Dimplex North America Limited, Cambridge (CA)

( * ) Notice: Subject to any disclaimer, the term of this patent is extended or adjusted under 35 U.S.C. 154(b) by 0 days.

(21) Appl. No.: 09/506,485

(22) Filed: Feb. 18, 2000

(30) Foreign Application Priority Data

Feb. 19, 1999 (CA) ..... 2 262 338

(51) Int. Cl.[7] ..... G09F 19/12
(52) U.S. Cl. ..... 40/428; 40/902; 472/65
(58) Field of Search ..... 40/428, 442, 902; 362/92, 806; 392/348; 472/65

(56) References Cited

U.S. PATENT DOCUMENTS

| | | | |
|---|---|---|---|
| 1,867,740 A | 7/1932 | Guy | |
| 2,285,535 A | 6/1942 | Schlett | 272/15 |
| 3,395,476 A | 8/1968 | Moss et al. | |
| 3,499,239 A | 3/1970 | Mungo | |

(List continued on next page.)

FOREIGN PATENT DOCUMENTS

| | | |
|---|---|---|
| EP | 0611921 | 8/1994 |
| GB | 414280 | 8/1934 |
| GB | 975009 | 4/1963 |
| GB | 1024047 | 2/1965 |
| GB | 1088577 | 1/1966 |
| GB | 1164143 | 9/1969 |
| GB | 1407826 | 10/1975 |
| GB | 1443772 | 7/1976 |
| GB | 1457540 | 12/1976 |
| GB | 2149090 | 6/1985 |
| GB | 2151772 | 7/1985 |
| GB | 2180927 | 4/1987 |
| GB | 2198835 | 6/1988 |
| GB | 2230335 | 9/1989 |
| GB | 2240171 | 1/1990 |
| GB | 2256040 | 5/1991 |
| GB | 2261942 | 6/1993 |
| GB | 2264555 | 9/1993 |
| GB | 9502867 | 2/1995 |
| GB | 2290865 | 1/1996 |
| GB | 2298073 | 8/1996 |
| WO | WO 97/41393 | 11/1997 |

OTHER PUBLICATIONS

EPRI Electric Power Research Institute, *Residential Electric Fireplaces Review of the State of the Art,* May 1997.

*Primary Examiner*—Brian K. Green

(57) ABSTRACT

A device is provided for enhancing the realistic appearance of flames produced by a simulated fireplace (gas or electric) by providing additional ambient lighting effects in response to sensed light intensity within the fireplace. The device includes a photosensor, a control circuit, and display lighting. The photosensor senses the level of light intensity produced by a simulated flame source and changes its resistive value accordingly. The control circuit has circuit parameters which uses the resistive value of the photosensor to determine whether to apply operational power to the display lighting. The display lighting consists of at least one lamp positioned above the simulated fuel bed. When simulated fireplace is operational, the display lighting of the device produces a "flickering" effect that is synchronized with the changes in light intensity occurring within the fireplace. The resulting ambient lighting effect realistically mimics the changes in light intensity that normally occur above the flames of a real wood burning fireplace.

3 Claims, 6 Drawing Sheets

U.S. PATENT DOCUMENTS

| | | | | | |
|---|---|---|---|---|---|
| 3,710,182 | A | * | 1/1973 | Van Reenen | 315/199 |
| 3,730,138 | A | | 5/1973 | Suchowski | 119/5 |
| 3,742,189 | A | | 6/1973 | Conroy et al. | 219/367 |
| 3,978,598 | A | | 9/1976 | Rose et al. | |
| 4,026,544 | A | | 5/1977 | Plambeck et al. | 272/14 |
| 4,064,414 | A | * | 12/1977 | Bergeson et al. | 315/208 |
| 4,253,045 | A | * | 2/1981 | Weber | 315/210 |
| 4,573,905 | A | | 3/1986 | Meyers | 431/125 |
| 4,688,548 | A | | 8/1987 | Stoughton | 126/298 |
| D292,152 | S | | 10/1987 | Meyers | D6/450 |
| D292,251 | S | | 10/1987 | Meyers | D6/450 |
| 4,726,351 | A | | 2/1988 | Whittaker et al. | 126/127 |
| 4,883,043 | A | | 11/1989 | Thow et al. | 126/512 |
| 4,890,600 | A | | 1/1990 | Meyers | 126/512 |
| 4,940,407 | A | | 7/1990 | Rehberg et al. | 431/126 |
| 4,965,707 | A | | 10/1990 | Butterfield | 362/96 |
| 5,000,162 | A | | 3/1991 | Shimek et al. | 126/512 |
| 5,081,981 | A | | 1/1992 | Beal | 126/92 R |
| 5,195,820 | A | | 3/1993 | Rehberg | 362/523 |
| 5,469,839 | A | | 11/1995 | Kasulis et al. | 126/552 |
| 5,525,177 | A | | 6/1996 | Ross | 156/240 |
| 5,743,038 | A | | 4/1998 | Soto | 40/743 |
| 5,760,851 | A | * | 6/1998 | Inbar et al. | 40/361 X |
| 5,787,618 | A | | 8/1998 | Mullis | 40/219 |
| 5,850,830 | A | | 12/1998 | Smith | 126/552 |
| 5,988,159 | A | | 11/1999 | Blount | 126/512 |
| 6,006,742 | A | | 12/1999 | Jamieson et al. | 126/512 |

* cited by examiner

SYNCHRONIZED FLICKER DEVICE

FIELD OF THE INVENTION

The present invention is directed to simulated fireplaces and in particular, to devices for simulating flickering flames.

BACKGROUND OF THE INVENTION

Simulated fireplaces, such as gas or electric fireplaces, are becoming increasingly popular as an inexpensive and safe alternative to wood or coal burning fireplaces. Gas fireplaces produce a real flame using natural gas or propane. Electric fireplaces produce an illusory flame by reflecting and transmitting light through mirrored diffusing surfaces.

In both instances, the simulated fireplace is a reasonable but imperfect simulation of a real fireplace. While improvements are continually being made to the realistic appearance of the simulated fireplaces, such improvements have been directed to the appearance of the flames or the simulated fuel bed. One area that has been overlooked until the present invention is the importance of simulating the ambient light changes that are associated with the flickering flames of the simulated fireplace. This is particularly a problem with electric fireplaces in which the illusory flame does not transmit light in the same fashion that a real flame does.

What is needed is a device for a simulated fireplace that more realistically simulates the ambient light changes associated with the flickering of flames in a real fireplace.

SUMMARY OF THE INVENTION

In one aspect, the present invention provides a device for enhancing the realistic effect of flames produced by a simulated fireplace by providing ambient lighting effects, said device comprising:

(a) a sensor for sensing the light intensity provided by a flame source of a simulated fireplace;

(b) a light source having input terminals, for emitting light according to the amount of operational power provided across said input terminals; and (c) a control circuit operatively coupled to said sensor and to the input terminals of said light source, for providing operational power across said input terminals in accordance with the light intensity sensed by said sensor.

BRIEF DESCRIPTION OF THE DRAWINGS

For a better understanding of the present invention, and to show more clearly how it may be carried into effect, reference will now be made, by way of example, to the accompanying drawings. The drawings show preferred embodiments of the present invention, in which.

DETAILED DESCRIPTION OF THE PREFERRED EMBODIMENT

Figure 1:
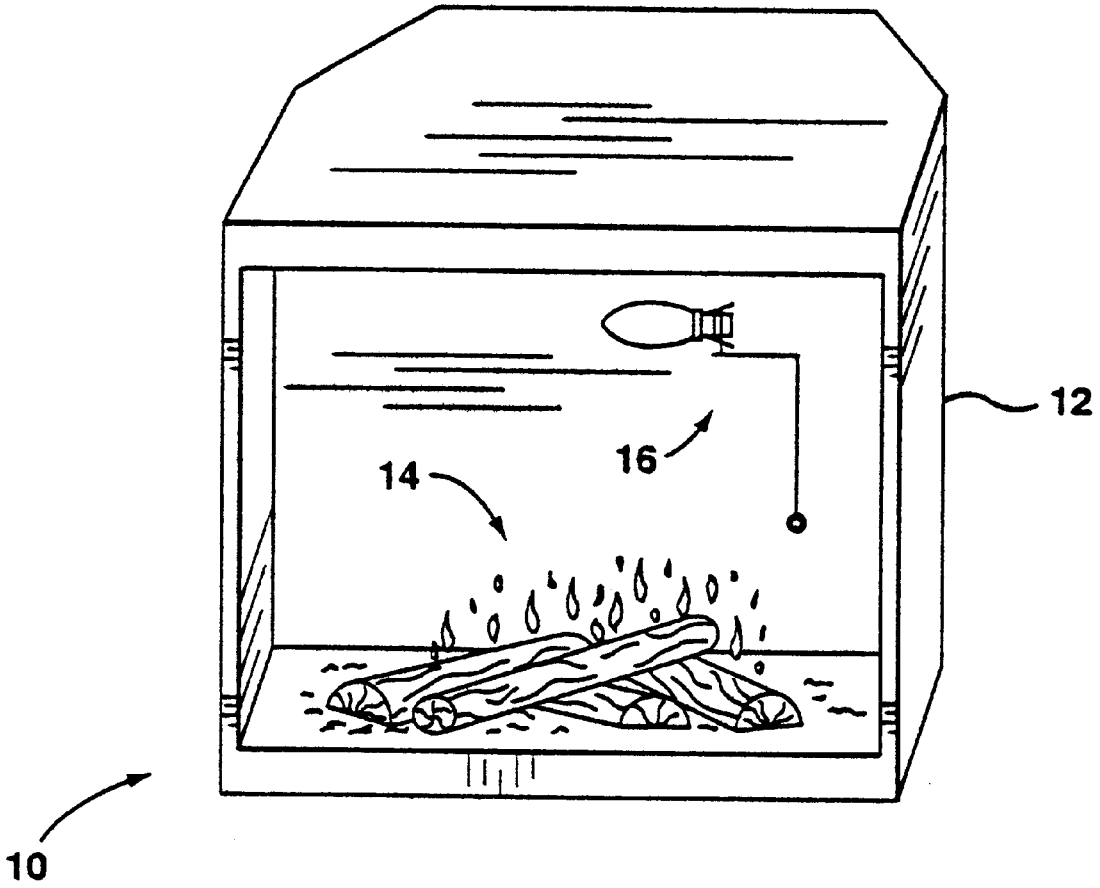
FIG. 1 is a simplified schematic view of a simulated fireplace incorporating a light flickering device in accordance with the present invention.

Referring to FIG. 1, a schematic representation of a simulated fireplace is shown generally at 10. Simulated fireplace 10 includes a housing 12, a flame source 14 for producing flames, and a light flickering device 16 in accordance with the present invention.

Flame source 14 can either produce real flames, as would be produced from a gas fireplace, or illusory flames, as would be produced by an electric fireplace. For gas fireplaces, the flame producing apparatus could comprise gas inputs and nozzles (not shown) as known in the art. For electric fireplaces, the flame producing apparatus could comprise light sources and reflectors (not shown) as known in the art.

Figure 2:
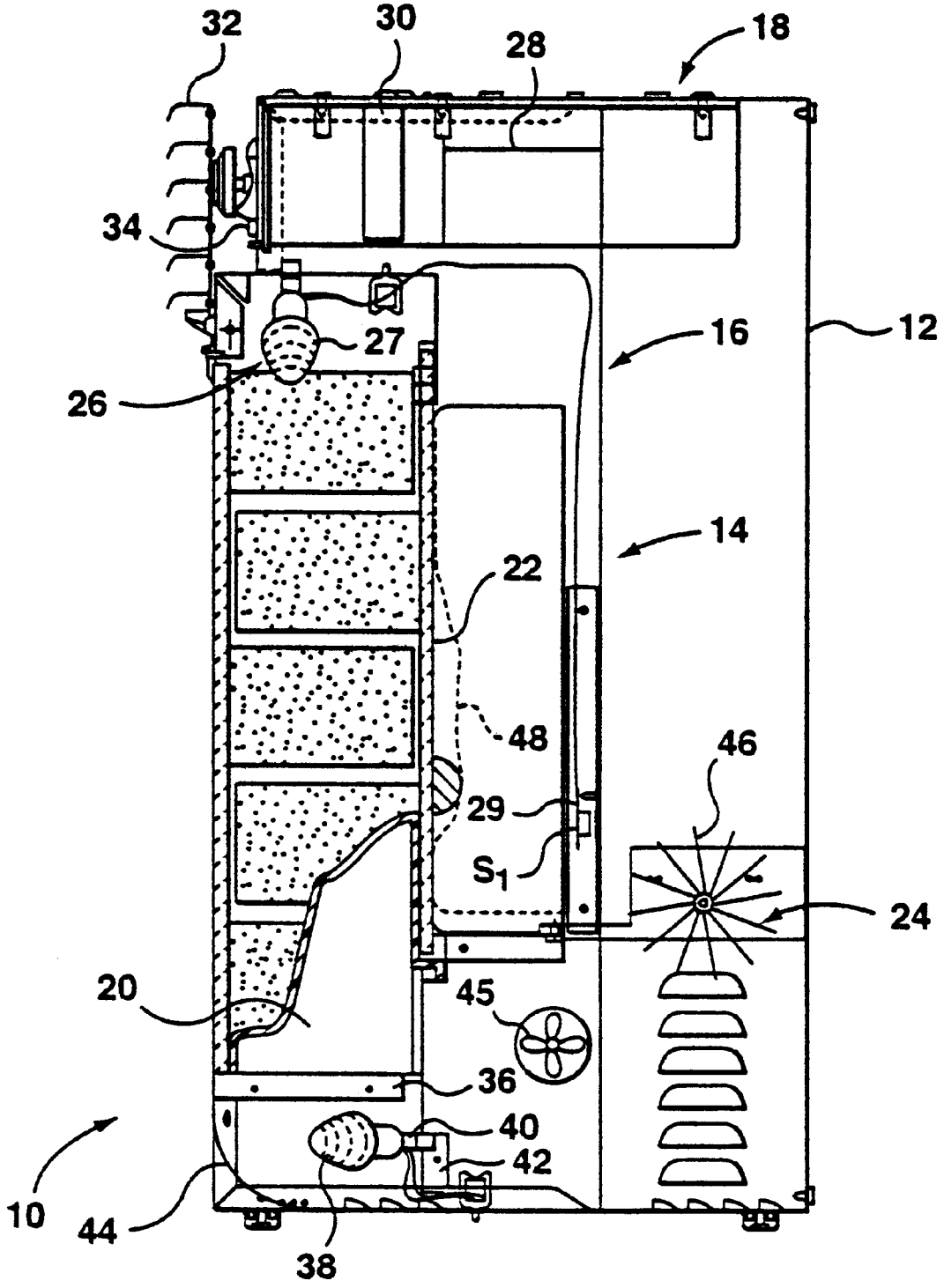
FIG. 2 is a partially cut-away side view of an electric type of simulated fireplace incorporating a light flickering device in accordance with the present invention.

FIG. 2 shows a partially cut-away side view of simulated fireplace 10 which provides illusory flames using an electric flame source 14 and which creates enhanced ambient lighting conditions using light flickering device 16.

Flame source 14 is powered by an AC power source (not shown) and includes a control unit 18, a simulated fuel bed 20, a screen 22, and a flicker assembly 24. Control unit 18 includes a heater unit 28, a thermostat 30 for controlling the heat output, a grill vent 32, and a main power switch 34 for connecting flame source 14 to the AC power source (not shown).

Simulated fuel bed 20 is supported on a platform 36 located at a lower front portion of housing 12. Simulated fuel bed 20 comprises a plastic shell that is vacuum formed and coloured to resemble logs and embers for a log burning fire. Portions of the shell are translucent to permit light from a light source 38 located beneath simulated fuel bed 20 to shine through. Light source 38 comprises several 60 watt light bulbs that are supported in sockets 40 supported by vertical arms 42 coupled to the bottom wall of housing 12. A parabolic reflector 44 is located below light source 38 at the lower front end of housing 12 to direct light toward the rear of housing 12. Appropriate color and structural details of simulated fuel bed 20 are used to simulate different aspects of a fire, e.g. embers and the like, as is conventionally known.

Screen 22 is a vertical, transparent screen having a partially reflecting surface and a diffusing surface. Screen 22 is positioned immediately behind simulated fuel bed 20 so that simulated fuel bed 20 will be reflected in the reflecting surface of screen 22 to give depth, as is conventionally known. As will be explained, flicker assembly 24 will produce the image of simulated flames emanating from simulated fuel bed 20 and reflected in screen 22 to provide an overall appearance of a real fireplace.

Flicker assembly 24 includes a blower 45, a flicker element 46, and a flame effect element 48. Flicker element 46 contains a plurality of reflective strips or areas that have movement effected by blower 45. Flicker element 46 is rotated along its longitudinal axis such that the light reflected from parabolic reflector 44 to the back of housing 12 is reflected off of the reflective strips and onto screen 22. Flame effect element 48 is formed from a substantially opaque material (e.g. polyester) and contains a plurality of slits which permit passage of light through flame effect element 48 as it billows in response to air currents generated by blower 45. The construction and operation of the electric simulated fireplace 10 is disclosed in more detail in U.S. Pat. Nos. 4,965,707 and 5,642,580, which are incorporated herein by reference.

Light flickering device 16 includes display lighting 26 and a control circuit 29 that uses a photosensor $S_1$ to determine when to apply operational power to display lighting 26.

Display lighting 26 is used to illuminate simulated fuel bed 20 and to enhance the reflected image in screen 22. Display lighting 26 comprises one or more lamps 27 positioned along an upper front section of housing 12. The wattage of lamps 27 is preferably 15 watts but can be as low as 7 watts or as high as 25 watts when installed with a dimmer switch. Control circuit 29 controls the operation of the lamps 27 to enhance the simulated fireplace effects by providing ambient fireplace effects.

Referring to FIG. 2, photosensor $S_1$ of control circuit 29 exhibits a relatively high resistance when relatively low light conditions are present and a relatively low resistance in the presence of relatively bright light conditions. Photosensor $S_1$ is positioned in close proximity to the reflective strips of flicker element 24 or such other sufficient position to facilitate the detection of the intensity of the light generated by flame source 14. Control circuit 29 has certain circuit parameters selected so that when a certain light intensity threshold is exceeded, control circuit 29 will turn on display lamps 27 and when the detected light falls below the light intensity threshold, control circuit 29 will turn off display lamp 27. The light intensity threshold can be adjusted by appropriately modifying the values of the circuit components of control circuit 29, as will be described.

Figure 5:
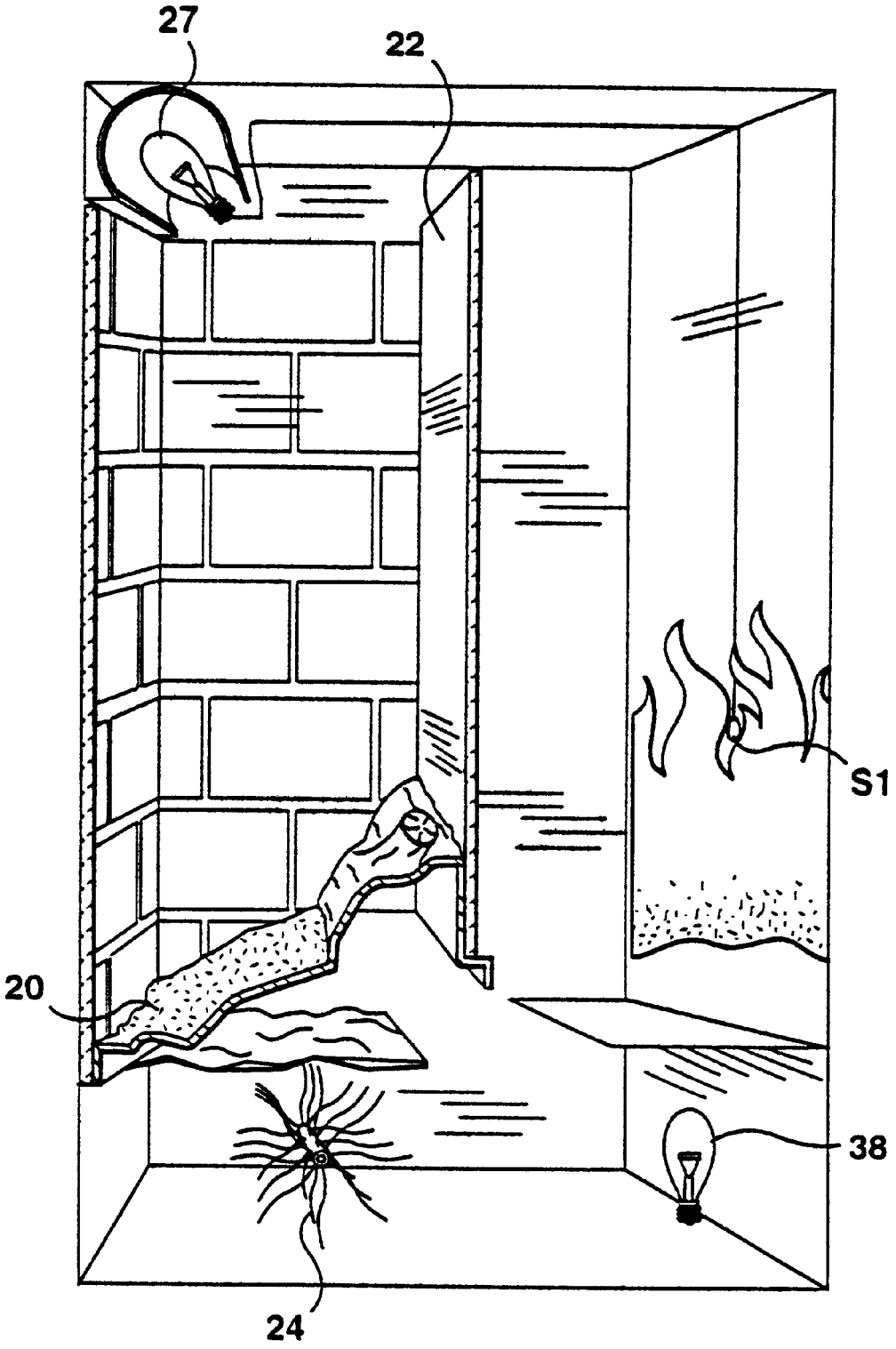
FIG. 5 is a schematic diagram of an electric type of simulated fireplace of FIG. 1 having alternative position for the photosensor.

Referring to FIG. 5, an alternate arrangement of photosensor $S_1$ is shown for a different embodiment of the electric fireplace. The photosensor $S_1$ is positioned on the back wall in a position to sense changes in light intensity from the flicker assembly 24.

Referring back to FIG. 2, control circuit 29 turns display lamp 27 on and off in accordance with the flickering of the light produced by flame source 14. This produces an ambient lighting effect that realistically mimics the changes in light intensity that normally occur above the flames of a real wood burning fireplace.

It should be understood that it is possible to configure control circuit 29 to control the operation of a number of display lamps 27, as long as the combined input impedance of display lamps 27 remains sufficiently low to allow control circuit 29 to provide enough current to drive display lamps 27. As well it is possible to couple a number of photosensors $S_1$ to control circuit 29 for more accurate light intensity detection.

Figure 3:
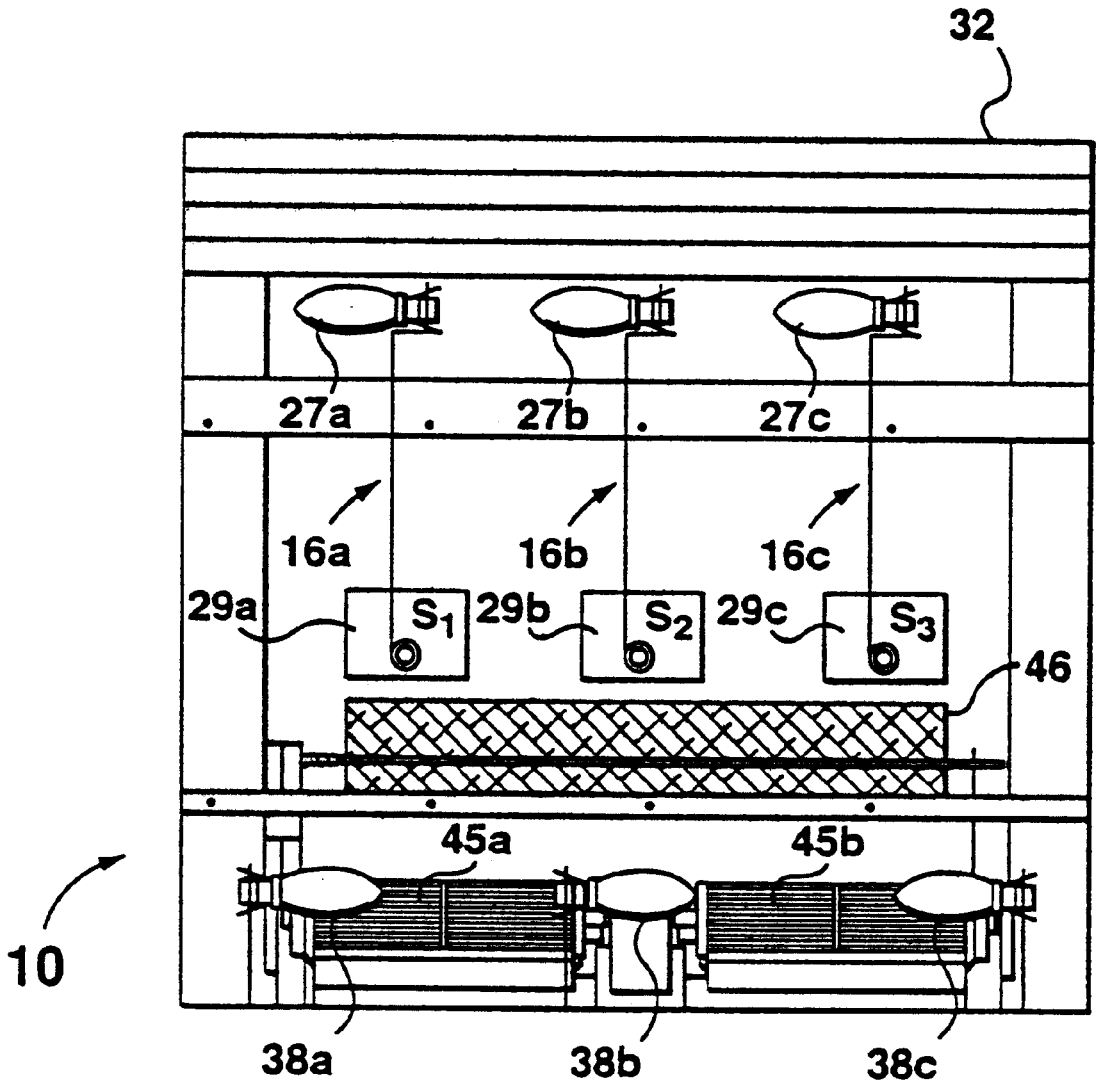
FIG. 3 is a partially cut-away front view of an electric type of simulated fireplace incorporating a plurality of light flickering devices in accordance with another embodiment of the present invention.

FIG. 3 shows a partially cut-away front view of simulated fireplace 10 using a number of light flickering devices 16*a,* 16*b,* 16*c*. As shown light sources 38*a,* 38*b,* and 38*c* are placed along the lower front end of housing 12 to provide an even distribution of light towards the rear of housing 12. Blowers 45*a* and 45*b* are positioned behind light sources 38*a,* 38*b,* and 38*c* and cause movement of the reflective strips of flicker element 46. Photosensors $S_1$, $S_2$, and $S_3$ are positioned above flicker element 46 to detect the light intensity generated by flame source 14.

Each photosensor $S_1$ , $S_2$ and $S_3$ causes a corresponding control circuit 29*a,* 29*b,* and 29*c,* to turn on a corresponding display lamp 27*a,* 27*b,* and 27*c,* when the light detected by photosensor $S_1$, $S_2$, and $S_3$ rises above the light intensity threshold. Correspondingly, each photosensor $S_1$, $S_2$ and $S_3$ causes a corresponding control circuit 29*a,* 29*b,* and 29*c,* to turn off a corresponding display lamp 27*a,* 27*b,* and 27*c,* when the light detected by photosensor $S_1$, $S_2$, and $S_3$ falls below the light intensity threshold. This causes a more realistic flickering effect, due to the independent positioning of each photosensor $S_1$, $S_2$, and $S_3$ relative to the light being sensed.

The light intensity threshold of each light flickering device 16*a,* 16*b,* and 16*c* can be individually adjusted by varying the appropriate circuit parameters of the appropriate control circuit 29*a,* 29*b,* and 29*c* for optimal performance and visual effectiveness. Accordingly, a more effective ambient lighting effect can be produced using multiple light flickering devices 16*a,* 16*b,* and 16*c*. The position and number of display lamps 27*a,* 27*b,* and 27*c* and photosensors $S_1$, $S_2$ and $S_3$ can be varied as desired to optimize the ambient flame effect within the desired cost parameters.

Figure 4:
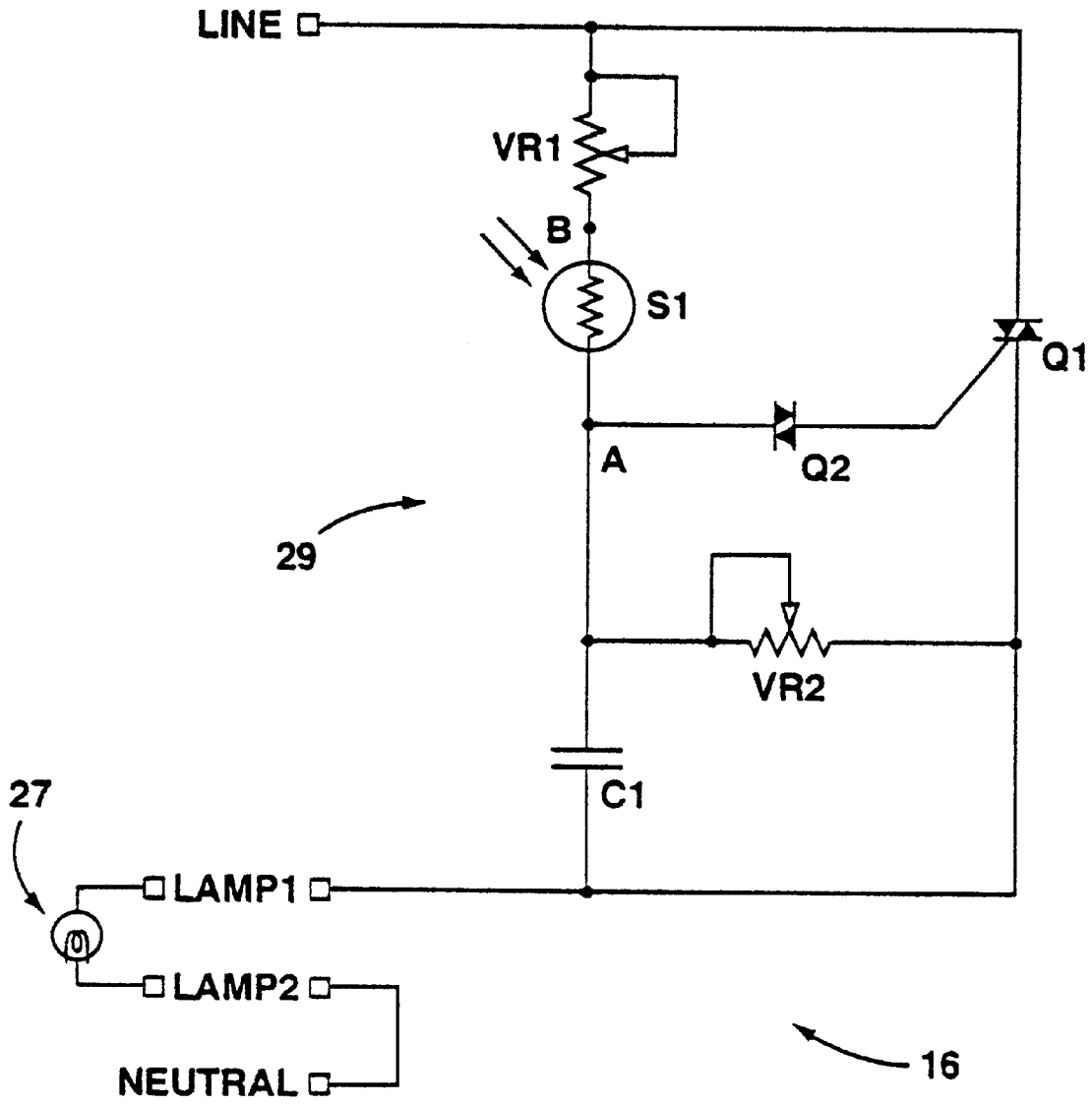
FIG. 4 is a schematic diagram of the light flickering device for the simulated fireplace of FIG. 1.

FIG. 4 shows the circuit schematic of light flickering device 16. Flickering device 16 comprises lamp 27 and control circuit 29. Display lamp 27 is connected to control circuit 29 at terminal LAMP1 and coupled to the neutral wire of the AC line voltage at terminal LAMP2.

Control circuit 29 includes photocell $S_2$, variable resistors $VR_1$ and $VR_2$, triac $Q_1$, diac $Q_2$, and capacitor $C_1$. Control circuit 29 is connected at terminal LINE to the hot wire of the AC line voltage from main power switch 34 and is connected at terminal LAMP1 to the power terminal LAMP1 of display lamp 27. As will be described, control circuit 29 causes the hot wire voltage at terminal LINE to appear at terminal LAMP1 to power display lamp 27 when a relatively bright light condition is detected by photocell $S_1$ and causes low voltage to appear at terminal LAMP1 which turns display lamp 27 off when a relatively low light condition is detected.

Photocell $S_1$ can be any commercially available photocell (e.g. the NSL-17-003 photocell manufactured by Silonex™). Photocell $S_1$ operates as a light sensitive resistor which changes its value in proportion to the amount of light detected by the light sensitive surface of the device. Specifically, the resistance value of the NSL-17-003 type of photocell $S_1$ varies from an approximate resistance of 1 kΩ when a bright light condition is detected to an approximate resistance of 50 kΩ when a low light condition is detected.

Triac $Q_1$ is a conventional bidirectional thyristor or a triac having a gate which, when triggered, causes triac $Q_1$ to conduct. It should be understood that triac $Q_1$ could be any other type of semiconductor switching element, such as a single thyristor or two thyristors arranged in an anti-parallel configuration. When the gate of triac $Q_1$ is triggered, triac $Q_1$ fully conducts and the voltage at terminal LINE1 is applied to display lamp 27.

Diac $Q_2$ is a gateless diac which is designed to breakdown at a threshold voltage and to conduct current in both directions. When the voltage applied across diac $Q_2$ exceeds its breakdown threshold, the voltage at point A will be discharged into the gate of triac $Q_1$, turning triac $Q_1$ on.

Variable resistors $VR_1$ and $VR_2$ are each coupled to photocell $S_1$ and to triac $Q_1$. Resistors $VR_1$ and $VR_2$ are used along with photocell $S_1$ within light flickering device 16 to form a voltage divider. The values of resistors $VR_1$ and $VR_2$ are such that when photocell $S_1$ detects a bright light condition, the voltage at point A rises past the breakdown threshold voltage of diac $Q_2$ (to trigger triac $Q_1$) and when photocell $S_1$ detects a low light condition, the voltage at A drops below the breakdown threshold voltage of diac $Q_2$ (so that triac $Q_1$ no longer conducts). It has been determined that suitable voltages are produced at point A by selecting resistor values 6.9 kΩ and 2.2 kΩ for resistors $VR_1$ and $VR_2$, respectively, when a NSL-17-003 type photocell is used. It should be noted that by manually adjusting variable resistors $VR_1$ and $VR_2$, the light intensity threshold can be set to provide optimal visual effectiveness.

Capacitor $C_1$ is coupled between resistor $VR_2$ and triac $Q_1$ and is used to filter out voltage transients which are produced when triac $Q_1$ and diac $Q_2$ are switched off. In this way lamp 27 is protected from damaging voltage spikes.

Accordingly, when a light condition is first detected by photocell $S_1$, the resistance of photocell $S_1$ will be approximately 1 kΩ. This relatively low resistance (in relation to the 2.2 kΩ resistance of resistor $VR_2$) will cause the voltage at point A to rise above the breakdown threshold voltage of diac $Q_2$ which will cause triac $Q_1$ to conduct. Accordingly, the voltage at terminal LINE1 will be directly applied across display lamp 27 as shown, and display lamp 27 will turn on.

When low light conditions are subsequently detected by photocell $S_1$, the resistance of photocell $S_1$ will rise substantially to 50 MΩ. This will cause diac $Q_2$ to turn off. Since no current is provided to the gate of triac $Q_1$, triac $Q_1$ will stop conducting. This will result in the voltage at terminal LINE1 being applied across the series combination of resistor $VR_1$, the resistance of photocell $S_1$, and the parallel combination of capacitor $C_1$ and resistor $VR_2$. Since the resistance of photocell $S_1$ is comparatively high with respect to the resistance values of these other components, the voltage at terminal LAMP1 will drop to a value that is too low to sustain display lamp 27 and display lamp 27 will extinguish.

In this way, display lamp 27 will be flashed on and off in a synchronized fashion with the light changes detected by photosensor $S_1$. The resulting flashing will occur without any user-apparent switching delay, due to the fact that triac $Q_1$ and diac $Q_2$ are high speed switching elements. It should be noted that while photosensor $S_1$ has been described as being electrically connected to control circuit 29, it should be understood that it would be possible to have photosensor $S_1$ affect the resistance within the circuit remotely (i.e. by remotely controlling another variable resistor connected across nodes A and B of FIG. 4) using a wireless transmitter and receiver arrangement (not shown).

While FIG. 4 illustrates the operation of one photosensor $S_1$ in association with one display lamps 27 and one control circuit 29, it should be understood that a plurality of photosensors $S_1$ and/or a plurality of display lamps 27 could be used in association with one or more control circuits 29 to optimize the flame effect within the desired cost parameters.

It should be further understood that the embodiment of control circuit 29 can be manufactured at a relatively low cost. However, it would also be possible to modify control circuit 29 at a higher cost, to provide additional functionality. For example, display lamps 27 could be caused to provide light in proportion to the light sensed, by using an appropriately programmed microcontroller and timer circuit (e.g. a Motorola 6800 microcontroller and a Model 555 timer) which together could control the on/off operation of triac $Q_1$. As is conventionally known, by regulating the amount of time that triac $Q_1$ conducts, it is possible to vary the amount of current provided to lamps 27 between dim and full lamp current values.

A lower cost embodiment can be constructed in which no photosensors are provided and the display lamps 27 are caused to flicker in a random manner by use of an appropriately programmed microcontroller. The frequency of flickering can be adjusted through either through the light dimmer or the speed control for the flame effect.

Figure 6:
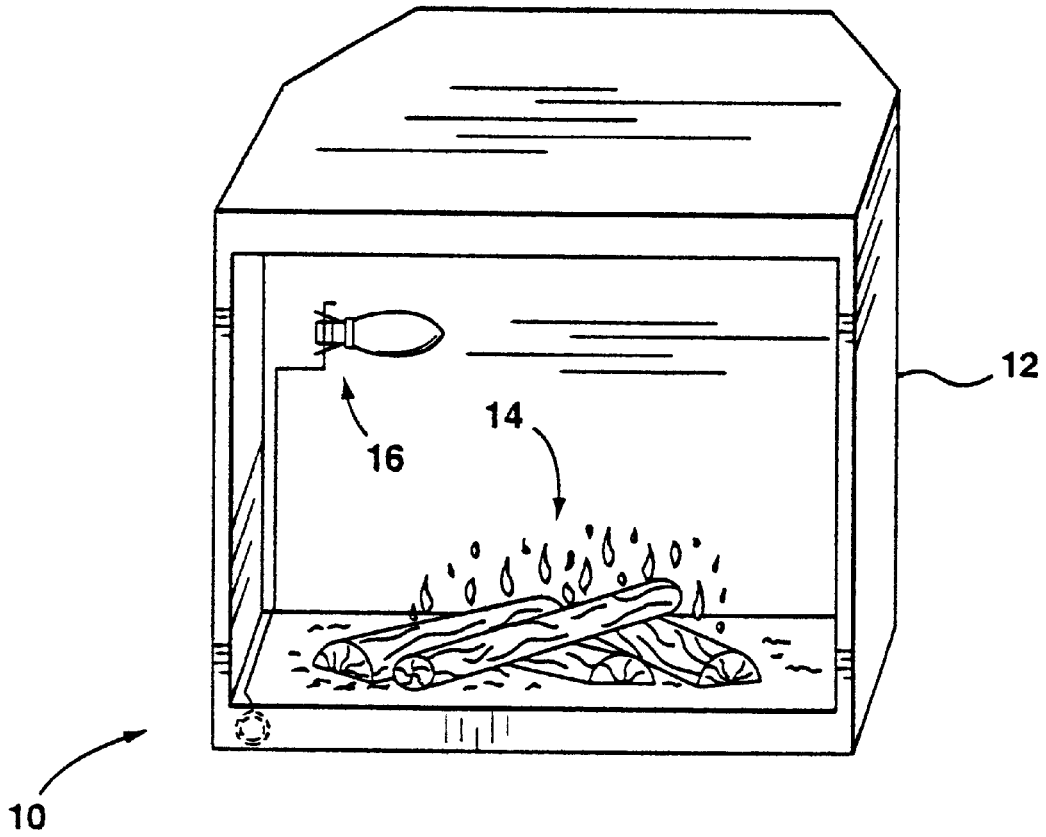
FIG. 6 is a simplified schematic view of a gas type of simulated fireplace incorporating a light flickering device in accordance with the present invention.

Finally, as shown in FIG. 6, light flickering device 16 can be adapted for use within a gas fireplace. Specifically, photosensor $S_1$ can be mounted on the inner surface of a hip 50 (as shown in dotted outline) within housing 12 such that photosensor $S_1$ is hidden from view by lip 50. Photosensor $S_1$ is also preferably positioned at a distance from flame source 14 such that photosersor $S_1$ is exposed to a level of heat which does not affect the operation or physical integrity of photosensor $S_1$.

It is to be understood that what has been described is a preferred embodiment to the invention. If the invention nonetheless is susceptible to certain changes and alternative embodiments fully comprehended by the spirit of the invention as described above, and the scope of the claims set out below.

The embodiments of the invention in which an exclusive property or privilege is claimed are defined as follows:

1. A simulated fireplace assembly including:

(a) a housing;

(b) a flame source disposed in the housing, the flame source comprising a simulated fuel bed, a screen positioned behind the simulated fuel bed, the screen having a front partially reflecting surface and a diffusing back surface, a light source, and a flicker element positioned in a path of light from the light source between the light source and the diffusing back surface, such that a simulated flickering flame is projected onto the screen, the simulated flickering flame having a varying intensity;

(c) at least one lamp located in the housing in a position to produce ambient lighting effects on the front partially reflecting surface and the simulated fuel bed, said at least one lamp being adapted to provide light having a variable intensity, said ambient lighting effects resembling varying ambient light produced by flickering flames;

(d) a control device operatively connected to said at least one lamp for varying the intensity of light emitted by said at least one lamp, to simulate varying ambient light produced by flickering flame;

(e) the control device including at least one sensor for sensing the intensity of the simulated flickering flame and a control circuit operatively connecting said at least one sensor to said at least one lamp for causing the intensity of the ambient lighting effects produced by said at least one lamp to increase and decrease contemporaneously with increases and decreases respectively of the intensity of the simulated flickering flame sensed by said at least one sensor.

2. A simulated fireplace assembly according to claim 1 in which said at least one sensor is a photosensor.

3. A simulated fireplace assembly according to claim 1 in which the control device includes a bidirectional thyristor for selectively providing approximately zero power to said at least one lamp when said at least one sensor senses that the intensity of the simulated flickering flame is relatively low, and providing power to said at least one lamp when said at least one sensor senses that the intensity of the simulated flickering flame is relatively higher.

* * * * *